United States Patent [19]

Spaulding

[11] 3,961,865

[45] June 8, 1976

[54] CONVERSION BRACKET FOR WELL PUMP

[76] Inventor: Vernon E. Spaulding, Rte. No. 3, Box 149, Vine Grove, Ky. 40175

[22] Filed: July 12, 1974

[21] Appl. No.: 488,031

[52] U.S. Cl. ..... 417/362; 417/374

[51] Int. Cl.[2] ..... F04B 9/14

[58] Field of Search ..... 417/374, 360, 362; 248/12; 166/685; 74/661, 216.5, 219, 362, 374

[56] References Cited

UNITED STATES PATENTS

| | | | |
|---|---|---|---|
| 1,970,681 | 8/1934 | Zimmerer | 417/374 |
| 2,727,468 | 12/1955 | Rykken | 417/362 |
| 3,153,388 | 10/1964 | Cheely | 417/362 |
| 3,320,895 | 5/1967 | Peterson et al. | 417/362 |

*Primary Examiner*—Samuel Scott
*Assistant Examiner*—A. Russell Burke
*Attorney, Agent, or Firm*—Woodard, Weikart, Emhardt & Naughton

[57] ABSTRACT

Disclosed is a bracket providing a housing through which a vertical shaft extends, the shaft being journalled for rotation in bearings carried by the housing. The lower end of the shaft extends into driving relation with a well pump from which the conventional electrical drive motor has been removed. Arms extending sidewardly from the housing are adapted to support an internal combustion engine having a vertical output shaft. A belt and pulley drive connect the output shaft and the pump drive shaft, with the belt extending within the space bounded by the sidewardly extending arms.

3 Claims, 4 Drawing Figures

CONVERSION BRACKET FOR WELL PUMP

BACKGROUND OF THE INVENTION

Electrical power failure and consequent power outages, as a result of storms, etc. can cause considerable inconvenience where a water well is served by an electric motor driven pump. Deep well pumps cannot be operated manually during these emergency intervals and a means for easily and conveniently converting, at least temporarily, the pump from electrical drive to internal combustion engine drive has distinct utility particularly for domestic users.

The bracket assembly of the present invention is utilized to provide the conversion function referred to above and includes sidewardly, horizontally extending members for positioning a small internal combustion engine at a position offset from the well head pump with the power transmission means extending between the engine and the pump shielded or guarded by the sidewardly extending members.

DESCRIPTION OF THE PREFERRED EMBODIMENT

Figure 1:
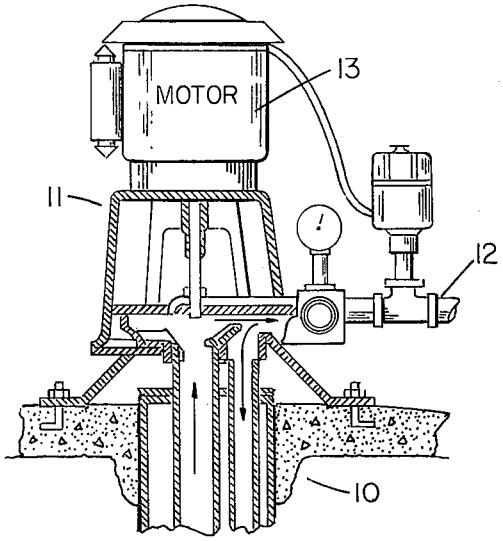
FIG. 1 is a schematic, side section view of a typical pump installation utilizing an electric motor power means for the pump.

Referring initially to FIG. 1, reference numeral 10 indicates a well head in which the well casing accommodates a conventional deep well, jet pump. The pump is indicated generally at 11 and has a discharge pipe 12, the conventional electric motor 13 being mounted above the pump with the motor drive shaft extending into rotational relation with the impeller of the pump. It will be understood that the construction so far described is typical of a conventional, deep well electric motor driven pump installation.

Figure 3:
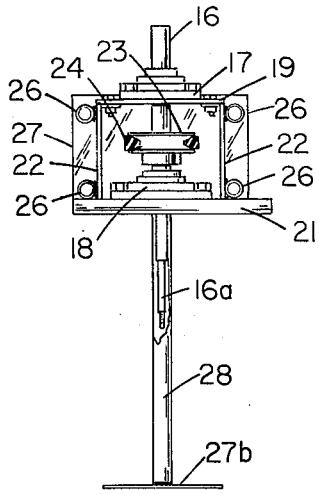
FIG. 3 is an end view of the bracket of the present invention.
Figure 2:
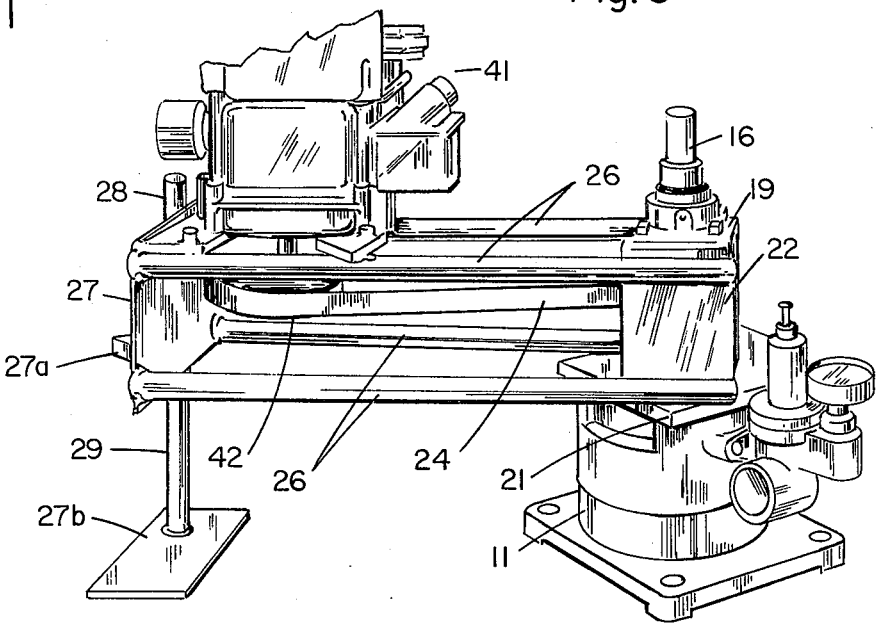
FIG. 2 is a perspective view of the conversion bracket of the present invention installed on a pump with the internal combustion engine in place.
Figure 4:
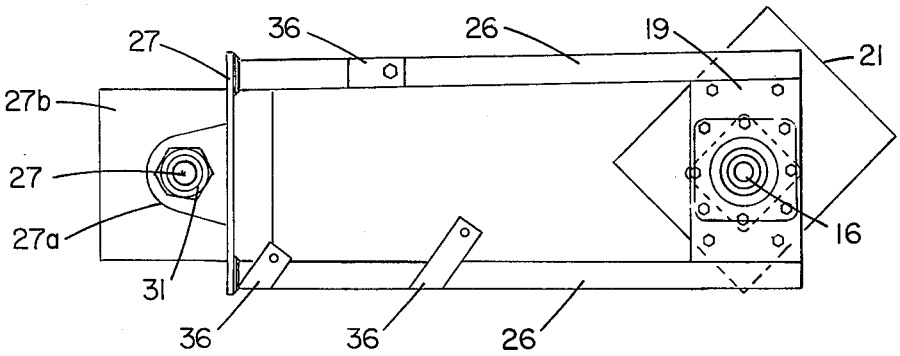
FIG. 4 is a top plan view of the bracket shown in FIG. 3.

The pump 11 is shown in FIG. 2 with the motor 13 removed and its drive shaft withdrawn from rotational engagement with the pump impeller. FIG. 2 shows the conversion bracket of the present invention installed on the pump with its drive shaft 16 extending downwardly into rotational relation with the pump impeller. The conversion bracket of the present invention is shown in detail in FIGS. 3 and 4. The downwardly extending portion of the drive shaft is shown at 16*a* in FIG. 3 and the shaft is journalled in bearings 17 and 18 carried by an upper plate 19 and a lower plate 21, respectively. The plates, together with side members 22 (welded to the plates) form a housing through which the shaft 16 extends. The portion of the shaft within the housing has rigidly secured to it a motion transmission component taking the form of a pulley 23 over which the belt 24 runs.

Welded to the side plates 22 and the bottom plate 21 are four symmetrically arranged arms 26. The remote ends of the horizontally extending arms are rigidly secured to an end plate 27. As will be evident from FIGS. 2 and 3, the end plate 27 has rigidly attached to it an adjustable support leg 28 having a threaded intermediate portion 29 which extends freely through an aperture in a sidewardly extending portion 27*a* of the end plate 27. A nut 31 is accommodated on the threaded portion 27*a* of the leg 27 above the flange 27*a* and an identical nut is positioned below the flange so that by adjusting the position of the nuts on the leg 27 the horizontally extending arms may be levelled, the foot portion 27*b* of the leg resting upon the floor or other supporting surface.

The upper two of the sidewardly extending arms 26 are provided with mounting lugs 36 (FIG. 4) which adapt the arms to support a small internal combustion engine of conventional type shown generally at 41 in FIG. 2, the lugs 36 serving to mount the engine. As is conventional the engine is of a type in which the output shaft extends vertically and accommodates a pulley 42 (FIG. 2) around which the belt 24 extends. The belt 24 and the pulleys 42 and 23 thus provide a motion transmission means extending between the engine output shaft and the drive shaft 16 of the bracket.

In operation, upon a failure of power to an electrically operated pump such as shown in FIG. 1, the electric motor may be removed from the pump and replaced by the bracket of the present invention, the bottom plate 21 closely overlying the pump and the drive shaft 16 extending into driving relation with the pump rotary components. The support leg 28 may then be adjusted so that the sidewardly extending arms 26 of the bracket are horizontal and, either before or after levelling, the internal combustion engine 41 may be attached and the belt 24 extended between the engine and the pulley carried by the drive shaft 16. Thereafter the engine may be utilized to drive the pump. Removal of the bracket and the placement of the motor may, as desired, occur after electrical power has been restored.

I claim:

1. A bracket assembly for converting a conventional well pump driven by an attached electric motor to internal combustion engine drive, said bracket assembly comprising in combination a drive shaft housing formed by horizontal upper and lower plates held in vertically spaced relation by vertical side members extending between the plates, a vertical drive shaft extending through and supported for rotation by said upper and lower plates, said lower plate being adapted to overlie a conventional well pump, the lower end of the drive shaft extending into drive relation with the pump, a plurality of spaced arms extending sidewardly from the upper portion of said drive shaft housing and rigidly secured to an end plate spaced horizontally from said drive shaft, a support leg carried by the end plate, a small internal combustion engine supported on said spaced arms with its output shaft extending vertically downward between said arms, and motion transmission means extending between the engine output shaft and said drive shaft and disposed in the space bounded by said spaced arms.

2. A bracket assembly as claimed in claim 1 in which said motion transmission means takes the form of a pulley secured to said engine output shaft and a pulley secured to the portion of said drive shaft extending between said upper and lower plates, and an endless belt extending between said pulleys.

3. A bracket assembly as claimed in claim 1 in which said support leg is adjustable axially with respect to said end plate to permit horizontal levelling of said arms.

* * * * *